United States Patent [19]

Cattin

[11] Patent Number: 5,044,622

[45] Date of Patent: Sep. 3, 1991

[54] APPARATUS FOR AUTOMATICALLY DISPENSING OBJECTS

[75] Inventor: Roger Cattin, Saignelegier, Switzerland

[73] Assignee: SADAMEL Societe Anonyme des Apparails de Mesure et de Laboratoire, Switzerland

[21] Appl. No.: 381,735

[22] PCT Filed: Oct. 17, 1988

[86] PCT No.: PCT/CH88/00194

§ 371 Date: Jun. 27, 1989

§ 102(e) Date: Jun. 27, 1989

[87] PCT Pub. No.: WO89/03798

PCT Pub. Date: May 5, 1989

[30] Foreign Application Priority Data

Oct. 27, 1987 [FR] France ..... 87 15033

[51] Int. Cl.[5] ..... B65H 3/52

[52] U.S. Cl. ..... 271/121; 271/167

[58] Field of Search ..... 271/22, 21, 24, 25, 271/126, 128, 147, 167, 169, 160, 25, 38, 110, 117, 121, 130, 137, 152

[56] References Cited

U.S. PATENT DOCUMENTS

| | | | |
|---|---|---|---|
| 3,126,122 | 3/1964 | Sacre | 271/21 X |
| 4,3287,889 | 6/1983 | Koyama et al. . | |
| 4,188,026 | 2/1980 | Kazumasa . | |
| 4,718,655 | 1/1988 | Okayama et al. | 271/126 X |

FOREIGN PATENT DOCUMENTS

| | | | |
|---|---|---|---|
| 213157 | 9/1909 | Fed. Rep. of Germany . | |
| 1955528 | 6/1970 | Fed. Rep. of Germany . | |
| 2219912 | 10/1973 | Fed. Rep. of Germany . | |
| 2346320 | 3/1975 | Fed. Rep. of Germany . | |
| 92837 | 5/1984 | Japan | 271/121 |
| 295946 | 12/1986 | Japan | 271/121 |
| 2160512 | 12/1985 | United Kingdom . | |

OTHER PUBLICATIONS

IBM Technical Disclosure Bulletin, vol. 20, No. 12, May 1978 (New York, U.S.) F. Y. Brandon et al.: "Wave Generator Paper Separation System", pp. 5119-5120.

IBM Technical Disclosure Bulletin, vol. 23, No. 7, Dec. 1980 (New York, U.S.), M. R. McAllister et al.: "Paper Feed Module", pp. 2677-2678.

Patent Abstracts of Japan, vol. 8, No. 189 (M-321( (1626) Aug. 30, 1987 & JP. A 5978013 (Kinseishiya K.K.), May 4, 1984, see whole document.

*Primary Examiner*—David H. Bollinger

*Attorney, Agent, or Firm*—Davis, Bujold & Streck

[57] ABSTRACT

The apparatus, according to the invention, comprises essentially a container (10) wherein is arranged a pile (11) of objects (12) to be distributed. A friction drive wheel (13) is mounted at the end of a lever (14) pivoting about an axis (15). An inclined ramp (21) is arranged downstream of the objects to be distributed. The upper part of the ramp is provided with a staircase-shaped recess (26) and is prolonged by a plane surface (22) which defines with a plane surface (23) parallel therewith a guiding channel (25) for guiding the objects (12).

10 Claims, 2 Drawing Sheets

APPARATUS FOR AUTOMATICALLY DISPENSING OBJECTS

Figure 1:
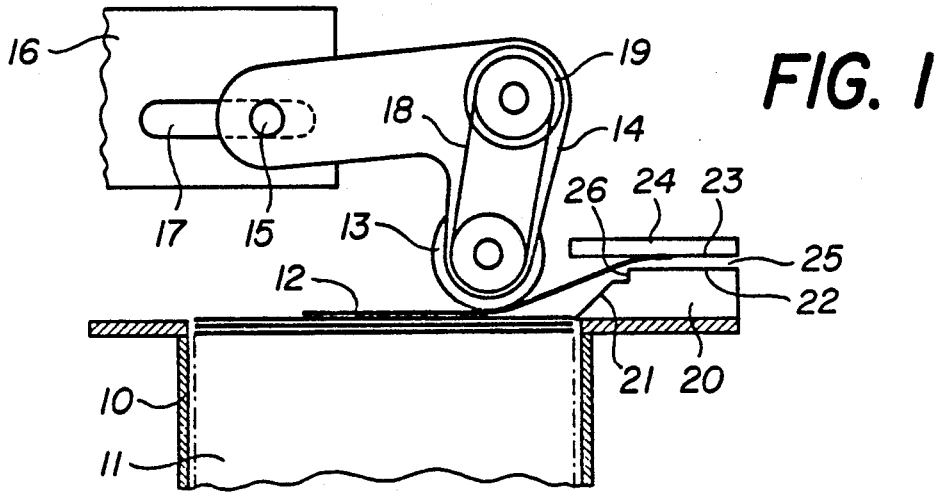

The present invention relates to a process for automatically dispensing objects, in particular objects which are relatively flexible and which are relatively thin when their thickness is compared with the other dimensions, such as, for example, cards, tickets of all types and booklets, which are stored in a free pile or disposed in a pile inside a suitable container, in which the object at the top of the pile is dispensed by means of a separating device comprising a rotary friction drive unit.

It also relates to an automatic dispenser for these objects, for the implementation of the above-mentioned process.

Various devices which ensure the automatic dispensing of tickets of all types or other objects as specified above are already known. These devices usually comprise relatively complex push-button systems, the purpose of which is to isolate one of the objects and to bring it into a position in which it can be taken by the user.

The object of the invention is to construct a simple apparatus which operates in accordance with a particularly reliable process, which ensures the selective dispensing of lotto playing cards, lottery tickets, tickets for public transport, etc. The characteristics of these dispensed objects are, on the one hand, a relative flexibility which can be attributed in particular to the nature of the materials used, such as paper, cardboard, synthetic material or composite materials, and, on the other hand, the relatively low value of the ratio between the thickness of the object and its other dimensions.

To this end the process according to the invention is characterised in that during a first phase of the process a constant predetermined pressure is exerted on the object to be dispensed by forcing the rotary friction drive unit against the free surface of said object by a predetermined force, in that during a second phase of the process the rotary friction drive unit resting on said object to be dispensed is actuated and this object is forced against an inclined ramp so that its front edge is raised, and in that during a third phase of the process the actuation of the rotary friction drive unit is continued and said front edge is engaged inside a guideway.

In a particularly advantageous embodiment, means are provided to arrest, at the entrance to said guideway, other objects which are initially disposed beneath said object to be dispensed and which are possibly carried along during the first two phases of the process.

The apparatus specified by the invention is characterised in that it comprises means for raising the front edge of said object, means for engaging this front edge of this object in a guideway and means for arresting, in front of the entrance to this guideway, any other objects which have been carried along simultaneously with the object to be dispensed.

In a preferred embodiment, said rotary friction drive unit consists of at least one friction wheel rotated by a drive unit, this wheel being mounted at the free end of a lever pivoting around a fixed axis.

Said means for raising the front edge of the topmost object advantageously comprise an inclined ramp, the base of which is situated at the same level as or beneath the level of the object to be dispensed and the upper part of which is situated above this level.

The guideway preferably comprises a first surface which connects the upper part of the inclined ramp and a second surface which is disposed substantially parallel to this first surface, at a predetermined distance from the latter. This distance separating the two surfaces is slightly greater than the thickness of one object and less than the thickness of two objects.

The means for arresting any objects other than the object at the top of the pile preferably comprise at least one step-like recess provided between the upper part of the ramp and said first surface. This step-like recess preferably comprises two successive stops which are staggered in height.

According to another particularly advantageous embodiment, the apparatus as specified by the invention may comprise means for raising the objects so that the first object in the pile to a great extent remains constantly at the same level, these means comprising a height-adjustable platform, connected to a rotating screw. The adjustable platform preferably pivots about a horizontal axis and is pulled by a spring resting against the base of the pile of objects.

Figure 2:
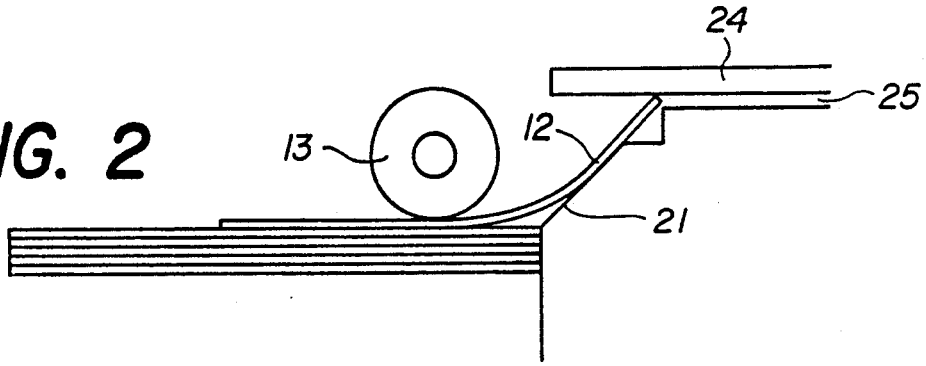
Figure 3:
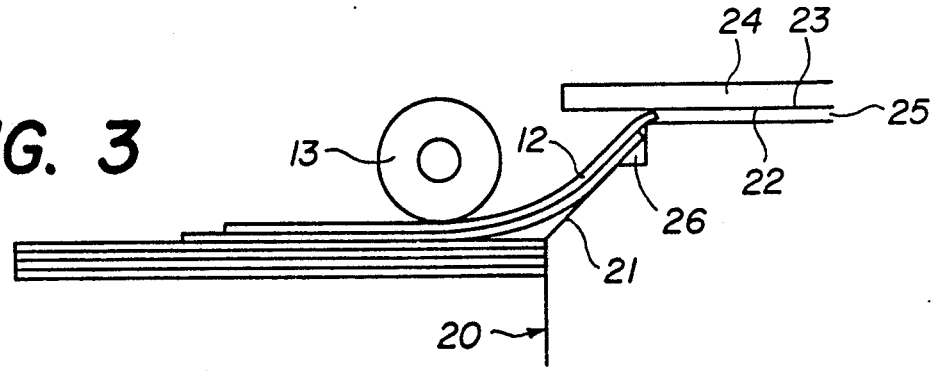
Figure 5:
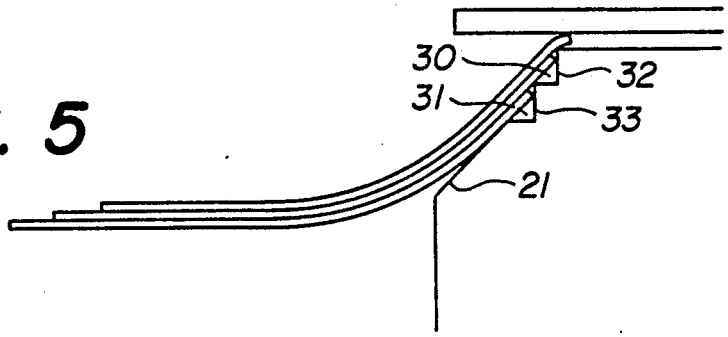
Figure 4:
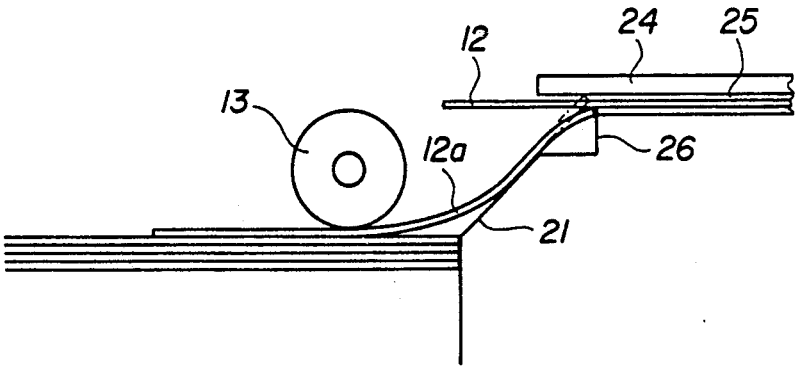
Figure 6:
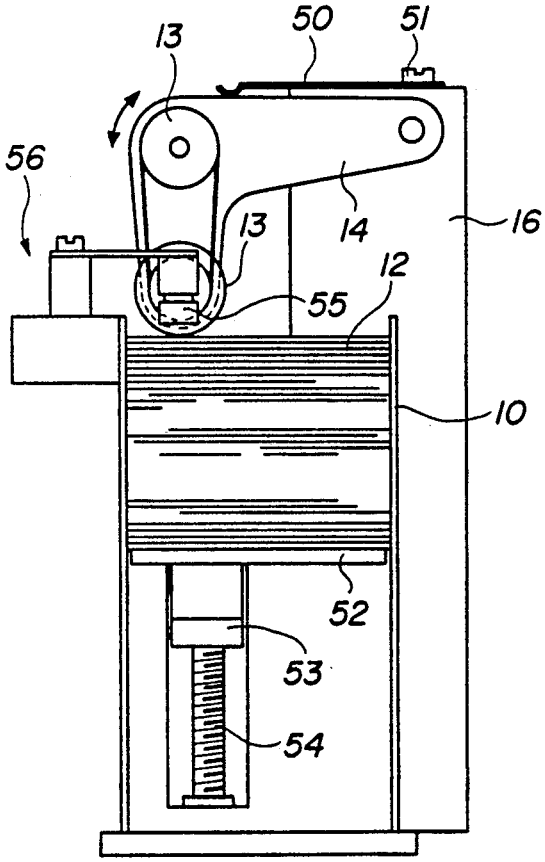
Figure 7:
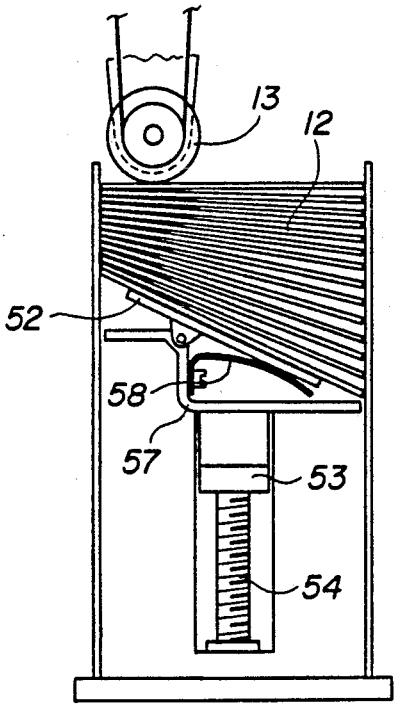

The present invention will be better understood by referring to the description of a preferred embodiment and the attached drawings in which:

FIG. 1 diagramatically illustrates a preferred embodiment of the apparatus specified by the invention, FIG. 2 diagrammatically represents the first phase of the process specified by the invention, FIG. 3 diagramatically represents the second phase of the process specified by the invention, FIG. 4 represents a third phase of the process specified by the invention, FIG. 5 illustrates a refinement of the ramp and the guideway of the apparatus specified by the invention, FIG. 6 illustrates a particular embodiment of the apparatus specified by the invention and FIG. 7 illustrates a refinement of the apparatus represented by FIG. 6.

With reference to the figures and more particularly to FIG. 1, the apparatus shown essentially comprises a container 10 in which there is a pile 11 of cards, tickets, sheets of paper, booklets, etc, 12, which are to be dispensed in succession. Naturally the container 10 of suitable shape may be replaced by a cassette or by any other per se known device. Generally speaking, this container may be equipped with means which ensure that the height of the pile is automatically maintained, i.e. these means automatically replenish the pile 11 as the objects 12 are dispensed. Such means are illustrated by way of example by FIGS. 6 and 7. The object 12 which is to be dispensed from the top of the pile is constantly brought up to the same level, preferably in a substantially horizontal plane.

The apparatus also includes a rotary friction drive unit which essentially comprises one or more friction wheel 13, comprising, for example, rollers having one or more peripheral grooves, on which are mounted, for example, one or more O-rings. This friction wheel is mounted at one end of an angle lever 14, which is hinged around a pivot 15 mounted on a fixed support 16 and engaged in a slot 17 which enables the position of lever 14 to be adjusted.

Wheel 13 is driven by a belt 18 passing over a drive wheel 19 which is integral with a drive motor (not shown).

In another embodiment, the rotary friction drive unit may be replaced by a push mechanism (not shown).

The apparatus also comprises a unit 20 having a ramp 21 inclined with respect to the surface of object 12 disposed on the upper part of pile 11. This unit has a plane upper surface 22, which, together with the plane lower surface 23 of a guide plate 24, defines a guideway 25 which is designed to be crossed by objects 12 at the moment they are dispensed. Unit 20 is also provided with a recess 26 in the form of a step which defines the junction of the upper part of ramp 21 and the plane upper surface 22 of part 20.

To dispense objects 12, the apparatus operates as follows: The rotary friction drive unit 13 exerts a predetermined pressure on the upper surface of object 12 which defines the top of the pile. Due to the effect of this predetermined pressure, the object, which is normally quite flexible, is raised slightly at its front end.

During the second phase of the process, which is illustrated by FIG. 2, object 12, which is carried along by friction wheel 13, is pushed against inclined ramp 21 and its front edge is raised, guided by this ramp.

As this figure clearly shows, in a first period of time the front edge of object 12 abuts against guide plate 24, then becomes deformed and is deflected so that it engages in guideway 25.

FIG. 3 illustrates the case in which two objects 12 are carried along simultaneously by friction wheel 13. The height of guideway 25 is determined so that two objects can not cross it simultaneously. The step-like clearance 26 forms a stop which is designed to arrest another object which is accidentally carried along with object 12, which is at the very top of the pile and which has to be dispensed. The position of the guide plate 24 with respect to the upper surface 22 of part 20 is a determining factor, according to the thickness of the objects, when one object 12 abuts against surface 23, for forcing a second object against the stop formed by recess 26 and for preventing this second object being carried along simultaneously with the first. The inclined ramp 21 also forms an angle of between 20° and 70° with the surface of objects 12.

As FIG. 4 shows, when a first object 12 is engaged in guideway 25, the following object 12*a* is brought into a waiting position. During its displacement towards this waiting position, object 12*a* slides over ramp 21 and its upper end comes to abut against the lower surface of the first object 12. The movement of translation of this object produces a deformation of this upper end which bends slightly and abuts against the vertical side of recess 26. As soon as the first object 12 has been dispensed, by being pulled manually from outside the dispensing machine, the upper end of the following object 12 becomes straight again before engaging in guideway 25 after the first object.

FIG. 5 illustrates a refinement in which recess 26 is replaced by two recesses 30 and 31 which form two successive steps, the vertical sides 32 and 33 of which form stops for objects which are possibly carried along simultaneously with the object to be dispensed from the pile.

The apparatus shown by FIG. 6 is similar to the apparatus shown in FIG. 1. The angle lever 14, which supports friction wheel 13, is pulled downwards by a leaf spring 50 or any other equivalent means, fixed by a screw 51 to the fixed support 16. The pile of objects 12 to be dispensed is stored in container 10, on a platform 52 which is mounted on a threaded unit 53 engaged in a screw 54. The latter can be rotated by means which are not illustrated, and as a result the platform is displaced and the top of the pile of objects 12 is constantly kept at the same level. A detector 55 enables the monitoring of the level of the pile and, if necessary, the transmission of a signal controlling the drive means for screw 54. This detector may be a mechanical contact, a capacative sensor etc., which is per se known. It is mounted on a fixed support 56.

FIG. 7 illustrates another device for raising objects 12, which differs from the system described above and illustrated by FIG. 6 in that it is designed to keep constant the level of objects 12 which have thicknesses which differ from one side to another. This is the case, for example, with covered and bound papers, and they are disposed as shown in the figure. In this case platform 52 is inclined and pivoted, and is mounted on a support 57 borne by a unit 53 which cooperates with a rotating screw 54. A spring 58 acts on platform 52 and keeps it in contact with the object at the bottom of the pile of objects 12.

The present invention is not restricted to the embodiments described, but can be subject to various modifications and appear in the guise of various refinements which would be obvious to a person skilled in the art. In particular, if the objects were rigid, it would be adequate to dispose a very slightly inclined ramp and a friction wheel which exerts a sufficiently weak pressure so as to avoid damage to the objects, so that the apparatus can ensure that the objects are dispensed.

We claim:

1. An apparatus for individually dispensing flexible laminar objects in succession from a stack, said apparatus comprising:

support means for supporting a said stack;

a guide unit defining a path to be followed by each object to be dispensed, the path comprising a guideway and a ramp located between the support means and an entrance of the guideway dimensioned to accommodate a single said object at a time, the ramp being inclined with respect to the guideway, the ramp having an upper portion situated adjacent the entrance of the guideway and a lower portion situated to receive the topmost object of a said stack, when present, and the guideway having a first surface defined by an upper guide plate which extends over an upper portion of the ramp;

at least one friction drive unit disposed above the support means and having friction drive means which engages the top surface of a said stack, when present, for conveying the topmost object thereof along the path;

a step-like recess disposed in the upper portion of the ramp and forming a stop adjacent the entrance of the guideway;

wherein during operation of said friction drive unit, a front edge of a said topmost object, when present, is carried along the path by sliding along the ramp and is brought into contact with the upper guide plate at the entrance of the guideway, and a said topmost object is deflected into the guideway by sliding along the upper guide plate.

2. An apparatus according to claim 1, wherein the support means comprises a height-adjustable platform which is connected to a rotary screw and nut adjustment device operable for raising the platform to maintain a substantially constant height of the top of a said stack, when present.

3. An apparatus according to claim 2, wherein the adjustable platform is pivotably about a horizontal axis of a support carried by the adjustment device, and the platform is biasable against a bottom surface of a said stack, when present, by a spring resting on the support.

4. An apparatus according to claim 1, wherein the friction drive means comprises at least one friction wheel rotated by a drive mechanism, and the friction wheel is mounted on a free end of a lever and is pivotable about a fixed axis.

5. An apparatus according to claim 1, wherein the guideway comprises a slot formed by the first surface of the upper guide plate and a second surface connected with the upper portion of the ramp, and the second surface is disposed substantially parallel to and at a predetermined distance from the first surface.

6. An apparatus according to claim 5, wherein the predetermined distance is slightly greater than the thickness of one of the objects to be dispensed and less than the thickness of two of the objects to be dispensed.

7. An apparatus according to claim 1, wherein the step-like recess comprises two successive recesses which are staggered along the ramp.

8. An apparatus according to claim 1, further comprising means for raising the objects to be dispensed so that a said object to be dispensed is constantly located adjacent the lower portion of the ramp.

9. An apparatus for individually dispensing flexible laminar objects in succession from a stack, said apparatus comprising:

support means for supporting a said stack;

a guide unit defining a path to be followed by each object to be dispensed, the path comprising a guideway and a ramp located between the support means and an entrance of the guideway dimensioned to accommodate a single said object at a time, the ramp being inclined with respect to the guideway, the ramp having an upper portion situated adjacent the entrance of the guideway and a lower portion situated to receive the topmost object of a said stack, when present, and the guideway having a first surface defined by an upper guide plate which extends over an upper portion of the ramp;

at least one friction drive unit disposed above the support means and having frietion drive means which engages the top surface of a said stack, when present, for conveying the topmost object thereof along the path;

a two successive recess disposed in and staggered along the upper portion of the ramp and forming a stop adjacent the entrance of the guideway;

wherein during operation of said friction drive unit, a front edge of a said topmost object, when present, is carried along the path by sliding along the ramp and is brought into contact with the upper guide plate at the entrance of the guideway, and a said topmost object is deflected into the guideway by sliding along the upper guide plate.

10. An apparatus for individually dispensing flexible laminar objects in succession from a stack, said apparatus comprising:

support means for supporting a said stack;

a guide unit defining a path to be followed by each object to be dispensed, the path comprising a guideway and a ramp located between the support means and an entrance of the guideway dimensioned to accommodate a single said object at a time, the ramp being inclined with respect to the guideway, the ramp having an upper portion situated adjacent the entrance of the guideway and a lower portion situated to receive the topmost object of a said stack, when present, and the guideway having a first surface defined by an upper guide plate which extends over an upper portion of the ramp;

at least one friction drive unit disposed above the support means and having friction drive means which engages the top surface of a said stack, when present, for conveying the topmost object thereof along the path;

a step-like recess disposed in the upper portion of the ramp and forming a stop adjacent the entrance of the guideway;

and means for raising the objects to be dispensed so that a said object to be dispensed remains constantly located adjacent the lower portion of the ramp;

wherein during operation of said friction drive unit, a front edge of a said topmost object, when present, is carried along the path by sliding along the ramp and is brought into contact with the upper guide plate at the entrance of the guideway, and a said topmost object is deflected into the guideway by sliding along the upper guide plate.

* * * * *